US007420522B1

(12) United States Patent
Steinbrecher

(10) Patent No.: US 7,420,522 B1
(45) **Date of Patent: *Sep. 2, 2008**

(54) ELECTROMAGNETIC RADIATION INTERFACE SYSTEM AND METHOD

(75) Inventor: Donald H. Steinbrecher, Brookline, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 403 days.

This patent is subject to a terminal disclaimer.

(21) Appl. No.: 10/956,526

(22) Filed: Sep. 29, 2004

(51) Int. Cl.
*H01Q 21/00* (2006.01)

(52) U.S. Cl. ..... 343/853; 343/893

(58) Field of Classification Search ..... 343/893, 343/895, 850, 770, 853
See application file for complete search history.

(56) References Cited

U.S. PATENT DOCUMENTS 4,006,481 A * 2/1977 Young et al. ..... 343/770
4,730,193 A * 3/1988 Schwartz et al. ..... 343/700 MS
5,258,771 A * 11/1993 Praba ..... 343/895
5,539,421 A 7/1996 Hong
5,926,147 A 7/1999 Sehm et al.
6,021,241 A 2/2000 Bilbro et al.
6,215,448 B1 4/2001 DaSilva et al.
6,285,495 B1 9/2001 Baranov et al.
6,292,140 B1 9/2001 Osterman
6,295,032 B1 9/2001 Podgorski
6,297,774 B1 10/2001 Chung
6,300,918 B1 10/2001 Riddle et al.
6,329,955 B1 12/2001 McLean et al.
2001/0003444 A1 6/2001 Mangenot et al.
2001/0033207 A1 10/2001 Anderson et al.
2001/0033377 A1 10/2001 Welch et al.

* cited by examiner

*Primary Examiner*—Michael C Wimer
(74) *Attorney, Agent, or Firm*—James M. Kasischke; Michael P. Stanley; Jean-Paul A. Nasser

(57) ABSTRACT

An electromagnetic radiation interface is provided that is suitable for use with radio wave frequencies. A surface is provided with a plurality of metallic conical bristles. A corresponding plurality of termination sections are provided so that each bristle is terminated with a termination section. The termination section may comprise an electrical resistance for capturing substantially all the electromagnetic wave energy received by each respective bristle to thereby prevent reflections from the surface of the interface. Each termination section may also comprise an analog to digital converter for converting the energy from each bristle to a digital word. The bristles may be mounted on a ground plane having a plurality of holes therethrough. A plurality of coaxial transmission lines may extend through the ground plane for interconnecting the plurality of bristles to the plurality of termination sections.

5 Claims, 8 Drawing Sheets

ELECTROMAGNETIC RADIATION INTERFACE SYSTEM AND METHOD

STATEMENT OF GOVERNMENT INTEREST

The invention described herein may be manufactured and used by or for the Government of the United States of America for governmental purposes without the payment of any royalties thereon or therefore.

CROSS-REFERENCE TO RELATED APPLICATIONS

This patent application is related to U.S. Pat. No. 7,250,920 entitled MULTI-PURPOSE ELECTROMAGNETIC RADIATION INTERFACE SYSTEM AND METHOD (Navy Case No. 82831) having the same filing date, which is hereby incorporated by reference in its entirety.

BACKGROUND OF THE INVENTION (1) Field of the Invention

The present invention relates generally to systems for controlling electromagnetic radiation, and more particularly to an electromagnetic wave interface that may be utilized to capture electromagnetic radiation such as radio waves and transform the radiation by some desired means such as by absorbing the radiation completely for stealth purposes, reflecting the radiation with desired characteristics that alter the radiation in a desired manner, by transforming the radiation into digital data without analog receivers, and/or otherwise processing the radiation.

(2) Description of the Prior Art

Traditional antenna theory requires that as the capture area of an antenna becomes smaller, the Q increases, and the bandwidth narrows. Thus, according to traditional antenna theory it is impossible to provide a wide bandwidth antenna with a small capture area. Moreover, prior art broadband receiving systems are performance limited by the inability to realize sufficient spurious-free dynamic range (SFDR) in the analog portions of the receiving systems. Prior art broadband receiving systems may often be limited to about 60 db SFDR.

Prior art antennas are also limited as to the type of functions that are available. Generally, prior art antennas are dedicated to perform a certain function and are not suitable for other specific functions. For instance, a prior art antenna design may be utilized as a transceiver. However, a prior antenna design will not be useable for transceiver operation, and/or stealth operation as being electrically "black," and/or altering radio wave electromagnetic radiation Doppler effects to produce a desired reflection which may indicate a body traveling at a different speed than it is, and/or for producing a radio reflection signature that may be different from the actual body producing the reflection.

The following U.S. patents describe various prior art systems that act in some way on electromagnetic radiation. Many of the disclosed structures are not broadband structures and several are limited to certain frequencies, such as sunlight, or other very specific functions not related to radio waveband electromagnetic radiation.

U.S. Pat. No. 3,836,967, issued Sep. 17, 1974, to R. W. Wright, discloses a structure for impeding the reflection of a beam of electromagnetic waves from the surface of an object and more particularly to a flexible, thin-wall structure which is suitable as a broadband absorber of microwave energy.

U.S. Pat. No. 4,582,111, issued Apr. 15, 1986, to R. D. Kuehn, discloses a substantially radiation absorbing layer of metal having a microstructured surface characterized by a plurality of randomly positioned discrete protuberances of varying heights and shapes, which protuberances have a height of not less than 20 nanometers nor more than 1500 nm, and the bases of which contact the bases of substantially all adjacent protuberances. The metal layer, which may be a coating on a variety of substrates, is useful as a radiation absorber (particularly solar). A method is disclosed for producing such layers.

U.S. Pat. No. 4,672,648, issued Jun. 9, 1987, to Mattson et al., discloses an off-focal radiation collimator which includes a plurality of radiation absorbing elements supported in spaced relationship with respect to one another in a housing such that each element is aligned along radii extending from the focal spot of a radiation source. The off-focal collimator is preferably disposed between the radiation source and a primary beam collimator. The off-focal collimator also acts as a radiation beam compensator. By varying the spatial density of the radiation absorbing elements by a function of location within the housing, the radiation beam can be shaped to any desired profile.

U.S. Pat. No. 4,942,402, issued Jul. 17, 1990, to Prewer et al., discloses an absorber for radiation of frequency of the order of 1 THz is formed of a body of cured silicone-based elastomer containing an inert, powdered siliceous filler. Both the elastomer and the filler are electrically insulating and the surface of the absorber that is exposed to the radiation is preferably profiled to enhance absorption of the radiation. The profiling preferably takes the form of an array of sharp-pointed pyramids having rectangular or triangular bases. A method of molding such absorbers is also disclosed.

U.S. Pat. No. 5,565,822, issued Oct. 15, 1996, to Gassmann et al., discloses a TEM waveguide arrangement such as are used in testing the electromagnetic compatibility of electronic devices in electromagnetic fields wherein a plate-shaped inner conductor is connected via electrically parallel-connected tubular resistors to an electrically conductive, spherical rear wall. This rear wall is electrically connected to an outer conductor and grounded. Radio-frequency absorbers are mounted on the rear wall for the purpose of absorbing TEM waves, the RF short-point absorbers adjacent to the tubular resistor being smaller than the remaining RF long-point absorbers, in order to reduce the capacitive influence of the tubular resistors. Identical tubular resistors are arranged perpendicular to the plane of the drawing of FIG. 1 in accordance with a current density distribution in such a way that they are more closely adjacent at the edge than in the middle of the inner conductor.

U.S. Pat. No. 5,710,564, issued Jan. 20, 1998, to Nimtz et al., discloses an electromagnetic wave measurement chamber wherein the sidewalls and the ceiling of the chamber are lined with contiguous pyramids. The pyramid vertices point into the chamber. The structure element has a frame formed by bars made of an electrically insulating glass fiber material and an outer skin. The outer skin is cut out of a surface resistance material web. The surface resistance material web is produced by continuously or almost continuously coating a mechanically flexible support web with an electroconductive layer made of a metallic material.

U.S. Pat. No. 6,295,032 B1, issued Sep. 25, 2001, to A. S. Podgorski, discloses electromagnetic radiating structures suitable for use as antennas or in electromagnetic field test facilities. An electromagnetic field test facility is a test enclosure used for observing the behavior of equipment in the presence of strong electromagnetic fields and for detecting radiation from the equipment. A broadband Gigahertz field electromagnetic test facility is also disclosed in which an array of horn antennas is used to illuminate a relatively large test area at high power densities, or to measure radiation from tested equipment in a frequency range extending from DC to hundreds of Gigahertz.

U.S. Patent Application Publication No. 2001/0003444 A1, published Jun. 14, 2001, to Mangenot et al., discloses a radiating source for transmitting and receiving, intended to be installed on board a satellite to define a radiation pattern in a terrestrial zone. The source is intended to be disposed in or near the focal plane of a reflector associated with other sources corresponding to other terrestrial zones. The source includes a plurality of radiating apertures, each of which has an efficiency at least equal to 70%, and feed means for feeding said radiating apertures. The radiating apertures and their feed means are such that the energy radiated by all of the radiating apertures is practically limited to the corresponding reflector, at least for transmission.

U.S. Patent Application Publication No. 2001/0033377 A1, published Oct. 25, 2001, to Welch et al., discloses systems for, and methods of controlling radial energy density profiles in, and/or cross-section dimensioning of electromagnetic beams in polarimeters, ellipsometers, reflectometers and spectrophotometers.

U.S. Patent Application Publication No. 2001/033207 A1, published Oct. 25, 2001, to Anderson et al., discloses phase shifting plasma electromagnetic waveguides and plasma electromagnetic coaxial waveguides, as well as plasma waveguide horn antennas, each of which can be reconfigurable, durable, stealth, and flexible are disclosed. Optionally, an energy modifying medium to reconfigure the waveguide such that electromagnetic waves of various wavelengths or speeds can be propagated directionally along the path can be used. Similarly, these waveguides may be modified into coaxial configurations.

U.S. Pat. No. 6,300,918 B1, issued Oct. 9, 2001, to Riddle et al., discloses a phased array antenna that includes a plurality of multiple spiral arm antenna elements. The antenna elements are hexagonal in shape and are aligned in a triangular lattice geometry, where the elements are arranged in rings around a common center element. The elements include at least two arms which terminate at opposite sides of the element. The ends of the arms of diagonally adjacent elements are positioned proximate to each other to provide inter-element coupling to increase the bandwidth of the antenna. The tight coupling of the antenna elements also reduces the RCS of the antenna.

U.S. Pat. No. 6,215,448 B1, issued Apr. 10, 2001, to DaSilva et al., discloses a selected length of antenna for a device under test which is placed within a conductive inner cylinder, forming an unterminated "input" coaxial transmission line. The inner cylinder is in turn within and coaxial with a conductive outer cylinder, forming an "output" transmission line. The inner cylinder is the center conductor of the output transmission line, and in a region extending beyond the extent of the antenna therein, conically tapers to being a normal center conductor of solid cross section. The outer cylinder matches this taper to maintain a constant characteristic impedance $Z_0$ say, 50 ohms, for the output transmission line, which then delivers its output signal to a matched terminating load in measurement equipment via either a coaxial connector or an interconnecting length of auxiliary transmission line. These triaxially nested input and output transmission lines are supported at a driven end by an RF tight box that contains a mounting fixture to support the device under test in a fixed and appropriate relation to the triaxially nested input and output transmission lines, and that is lined with anechoic RF absorbing material.

U.S. Pat. No. 6,021,241, issued Feb. 1, 2000, to Bilbro et al., discloses an array of optical fiber bundles includes one or more diffractive elements positioned above gaps between adjacent bundles. Incident radiation produces mathematically determinative diffraction patterns on the respective input faces of the adjacent bundles. Radiation intensity values for areas between and along the abutting edges of adjacent optical fiber bundles can be determined using the diffraction patterns. These intensity values can be assigned to other pixels so that precise, seamless images can be reconstructed.

U.S. Pat. No. 6,285,495 B1, issued Sep. 4, 2001, to Baranov et al., discloses an optical element comprising a plurality of transparent layers comprising one or more passive layers and one or more active layers wherein said passive layers facilitate the transmission of electromagnetic radiation in a substantially unaltered form and the at least one active layers include an active material dispersed through the active layer and having the capacity to intercept electromagnetic radiation of at least one predetermined wavelength or range of wavelengths and redirect at least a portion of energy of the intercepted radiation into the interior of the optical element, said layers being in face to face relationship and being optically coupled to each other.

U.S. Pat. No. 6,329,955 B1, issued Dec. 11, 2001, to McLean et al., discloses a broadband antenna incorporating both electric and magnetic dipole radiators includes a tapered feed, such as a bow-tie feed, having a central feed point and first and second outer regions displaced from the central feed point. One or more conducting loop elements are connected between the outer regions of the tapered feed. Top loading capacitive elements extending from each of the outer regions may also be provided.

U.S. Pat. No. 6,297,774 B1, issued Oct. 2, 2001, to H. H. Chung, discloses a high performance phased array antenna system for receiving satellite communication signals, with a structural top layer formed as a perforated plate (or solid plate made of very low loss plastic material), a middle layer functioning as the single layer antenna aperture layer, preferably in the form of a single layer printed circuit board on which is formed an array of antenna elements and plurality of stripline feed network circuits, each combining in-phase outputs from several adjacent antenna elements, the bottom layer functioning as the ground plane for the antenna aperture layer and also including a single level waveguide combining network for combining in-phase outputs from stripline feed network circuits electromagnetically coupled to respective transition probe holes of the waveguide combining network. Each antenna element is preferably a dual polarization octagonal patch antenna element disposed on a common surface of the antenna aperture layer. Each feed network circuit is preferably in a form of an air-stripline feed network separated by a layer of air dielectric from the ground plane and preferably is on the same surface of the antenna aperture layer as the antenna elements. The single level waveguide combining network is preferably an integral structure including dual orthogonal polarization waveguide sections and dual orthogonal polarization ports. The dual orthogonal polarization waveguide sections lay in the same plane and preferably are asymmetrically disposed on either side of a common wall, with each containing a branched cavity symmetrically disposed about a respective centerline.

U.S. Pat. No. 6,292,140 B1, issued Sep. 18, 2001, to D. P. Osterman, discloses a novel antenna which is useful in the manufacture of a bolometer integrated on a silicon chip. An opening in the silicon chip is spanned by two separate thermally, isolated structures. A thin-film antenna, comprising two parts, is located on the structures, with one antenna part on each structure. Radiation received in the larger of the two antenna parts is coupled electromagnetically into the smaller part, where it causes a current to flow. The current is dissipated as heat. A thin-film thermometer measures the temperature rise of the smaller antenna part, due to the dissipated heat. The bolometer achieves improved performance in comparison to previous bolometer designs because the radiation is dissipated in a part of the antenna only, and the bolometer is free from impedance-matching constraints of other designs.

U.S. Pat. No. 5,926,147, issued Jul. 20, 1999, Sehm et al., discloses an antenna design that includes a plurality of radiating elements which radiate electro-magnetic energy, and feeders which feed the electromagnetic energy to the radiating elements. The feeders have a supply network substantially at the same level in the antenna thickness direction. In order to achieve a small antenna with adequate properties for radio link usage, the radiating elements are arranged next to the supply network in the thickness direction and include box horn antennas which have a step, characteristic of a box horn, in the plane of the magnetic field.

U.S. Pat. No. 5,539,421, issued Jul. 23, 1996, to S. Hong, discloses a planar antenna, for use in satellite communication that is intended to provide higher aperture efficiency, improved circular polarization and increased production tolerability. The antenna comprises a waveguide and an array of M×N helical antenna elements, wherein M and N are integers. The waveguide includes a primary feeder waveguide and a set of M secondary feeding waveguides, wherein each of the M secondary feeding waveguides is provided with N helical antenna elements, each of the secondary feeding waveguides is coupled to the primary feeder waveguide through an aperture so that received signals from N helical antenna elements in each of the second feeding waveguides are combined at the primary feeder waveguide.

Prior art systems do not provide a broadband antenna with a small capture area. Moreover, the prior art typically does not provide a basic structure that can perform a variety of widely divergent functions to radio wave electromagnetic radiation such as, for instance, communication and radar. Thus, it would be desirable to provide a structure that permits complete absorption of electromagnetic radiation such as radar so as to eliminate reflections for stealth purposes and/or which may otherwise be utilized to more completely absorb radiation to act as an receiving antenna, and/or may be utilized as a broadcasting antenna, and/or as a modulating system to provide the receiving radar with inaccurate appearance of the return signal related to speed and shape, and/or other purposes as discussed in more detail hereinafter. Consequently, those skilled in the art will appreciate the present invention that addresses the above and other problems.

SUMMARY OF THE INVENTION

It is a general purpose and object of the present invention to provide an improved air interface device for functioning with electromagnetic radiation.

Another object is to provide an air interface system that may have a wide bandwidth which is comprised of a plurality of elements, each of which exhibits a small capture area.

Another object is to provide a system that may have improved stealth characteristics.

Another object is to provide a system that may have an improved spurious-free dynamic range (SFDR).

These and other objects, features, and advantages of the present invention will become apparent from the drawings, the descriptions given herein, and the appended claims. However, it will be understood that above listed objects and advantages of the invention are intended only as an aid in understanding aspects of the invention, are not intended to limit the invention in any way, and do not form a comprehensive list of objects, features, and advantages.

Accordingly, the present invention provides an electromagnetic wave interface system which may comprise one or more elements such as, for instance, an array of antennas forming a surface of the electromagnetic wave interface system wherein each antenna may be comprised of conductive material and wherein at least a portion of each antenna may preferably be conical. In one presently preferred embodiment, each antenna may comprise a distal end and a proximal end with the distal end comprising a distal end diameter at least five times smaller than the proximal end diameter.

Other components may comprise a plurality of termination sections. A respective one of the termination sections may be electrically connected to the proximal end for each of the array of antennas.

The system may further comprise a ground plane comprised of conductive material such that the proximal end of each of the array of antennas may be supported by the ground plane. The ground plane may define a plurality of ground plane holes therethrough. In one embodiment, respective ones of a plurality of electrical conductors extend through each ground plane hole for electrically connecting the termination section to each of the antennas. Each ground plane hole and each of the plurality of electrical conductors extending through the ground plane hole may preferably be in spaced annular relationship to another so as to define therebetween an annulus which is filled with dielectric material.

In one preferred embodiment, the system may further comprise a conductive region at the surface of each of the ground plane holes. Each the electrical conductors may be centrally disposed in the ground plane hole such that the conductive region and the electrically conductor and the dielectric material comprise a coaxial transmission line.

The system may further comprise a plurality of transmission lines for electrically connecting the array of antennas to the plurality of termination sections. In yet another embodiment, at least a portion of the plurality of termination sections comprises an integrated circuit.

In one embodiment, the termination sections may comprise one or more resistance elements with a magnitude selected for absorbing substantially all electromagnetic wave energy received by each respective antenna of the array of antennas. In another embodiment, each of the plurality of termination sections comprise an analog to digital converter for selectively converting electromagnetic wave energy received by each respective antenna of the array of antennas.

In one embodiment, each antenna projects from a reference surface, the array of antennas may be uniformly distributed over the reference surface. The reference surface may be a flat plane. Each antenna of the array of antennas may be equidistantly spaced in two perpendicular directions along the flat plane with respect to one another.

In yet another embodiment, the plurality of termination sections are programmable whereby the surface of the electromagnetic wave interface system is an active surface capable of creating a variable deceptive electrical appearance to impinging electromagnetic waves produced by a radar system. In this embodiment, the plurality of terminations sections may be programmed to produce variations in the active surface ranging from an electrically black appearance to the radar system whereby the impinging electromagnetic waves are absorbed, to reflecting the impinging electromagnetic waves with at least one of an altered phase or magnitude or frequency.

In another embodiment each of the plurality of termination sections further comprise an analog to digital converter for selectively converting electromagnetic wave energy received by each respective antenna of the array of antennas to a digital format.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DESCRIPTION OF THE PREFERRED EMBODIMENT

The present invention provides an electromagnetic radiation interface whose basic construction may be utilized to perform widely divergent functions, some of which are discussed hereinafter. Technically, the present invention is not an antenna in the traditional sense. An antenna in the traditional sense implies a device with a single port that can be coupled to a transmitter or a receiver. The present invention provides an air or space interface between a wide bandwidth of electromagnetic radiation and one or more processors. In one embodiment, different types of processors may be selectable so that the function of the interface is then also selectable. The present invention may be utilized as an antenna if all energy from each of the sensor elements, discussed hereinafter, is coherently recombined in an electronic system coupled to the elements of the surface. However, in another embodiment, the present invention may be utilized as an electrically "black" air or space interface surface that, with minimal loss, "guides" all incident electromagnetic energy to ports where the energy could either be recovered, or dissipated. If all the energy were recovered, then the surface would behave as an ideal antenna. If all energy were dissipated, then the interface surface would be an ideal coating for an electrically stealthy object. Alternative terminations may be utilized that cause the surface to appear to be one object when it is another. Actively modulating the terminations on the energy ports could cause a fixed object to appear to be moving, or a moving object to appear to be moving at a different speed.

Figure 1:
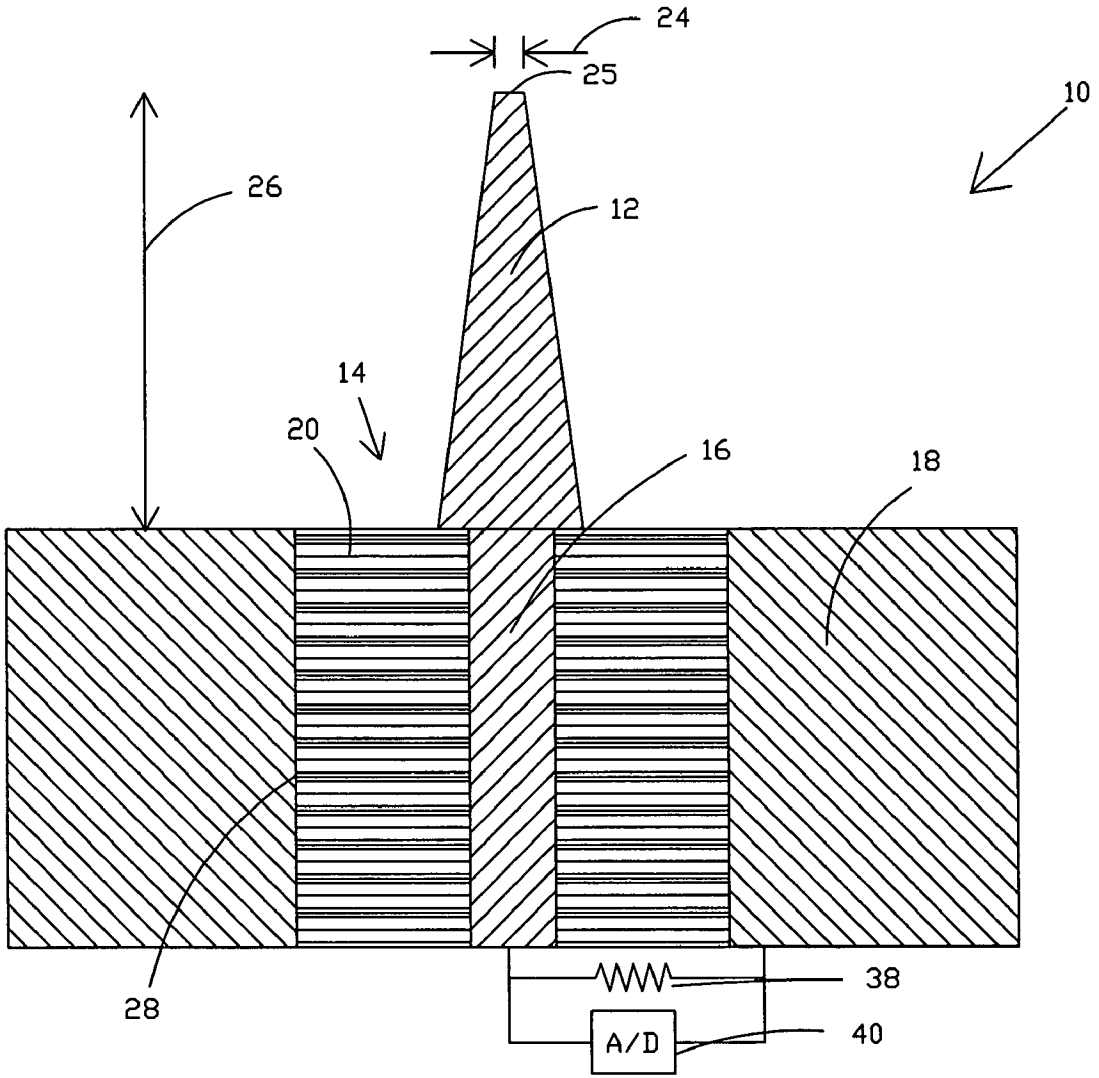
FIG. 1 is a cross-section taken along arrows I-I of FIG. 2, of an individual interface sensor in accord with one embodiment of the present invention.
Figure 2:
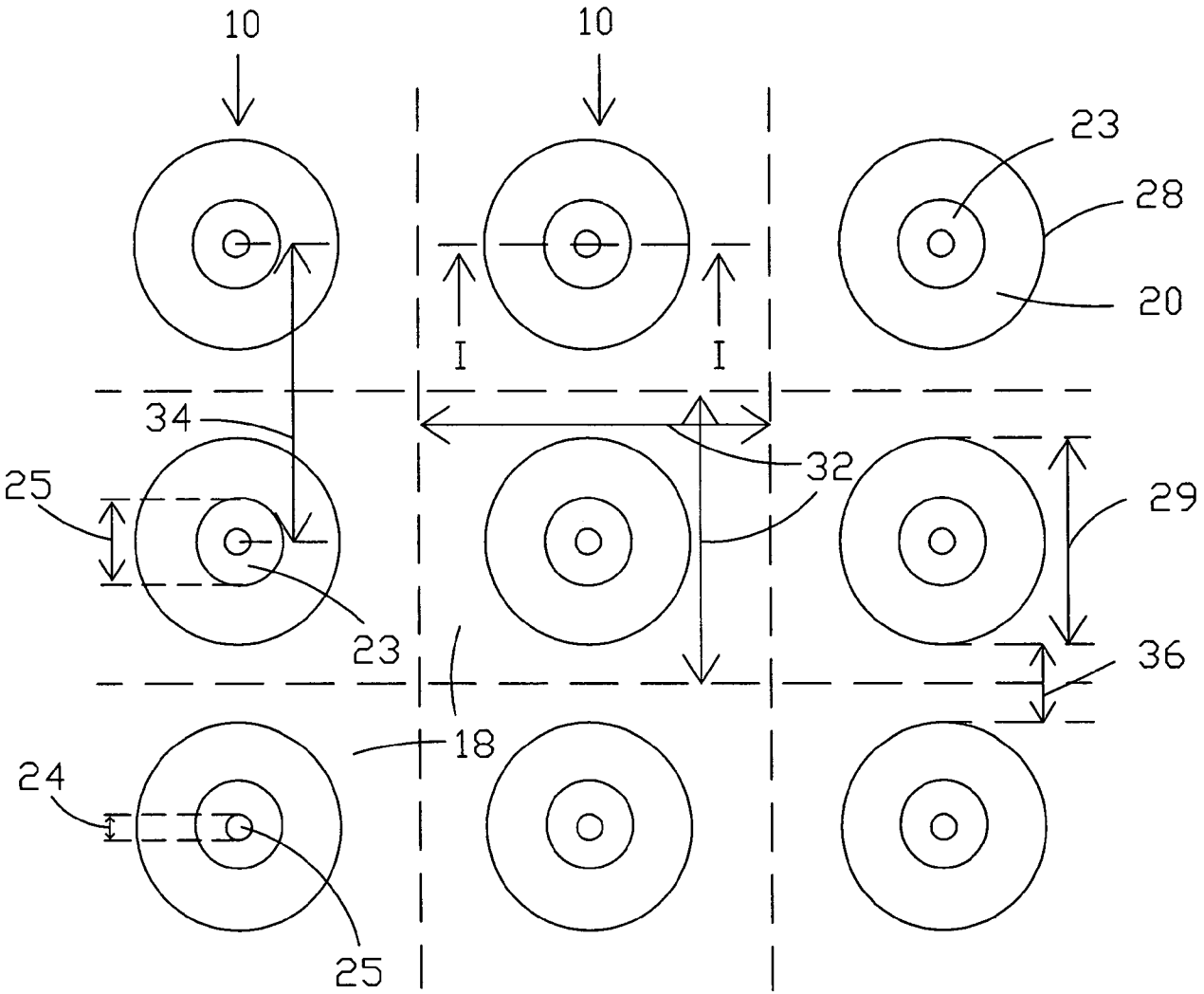
FIG. 2 is a top plan view showing a plurality of sensors of the type shown in FIG. 1 in accord with an embodiment of the invention.
Figure 3:
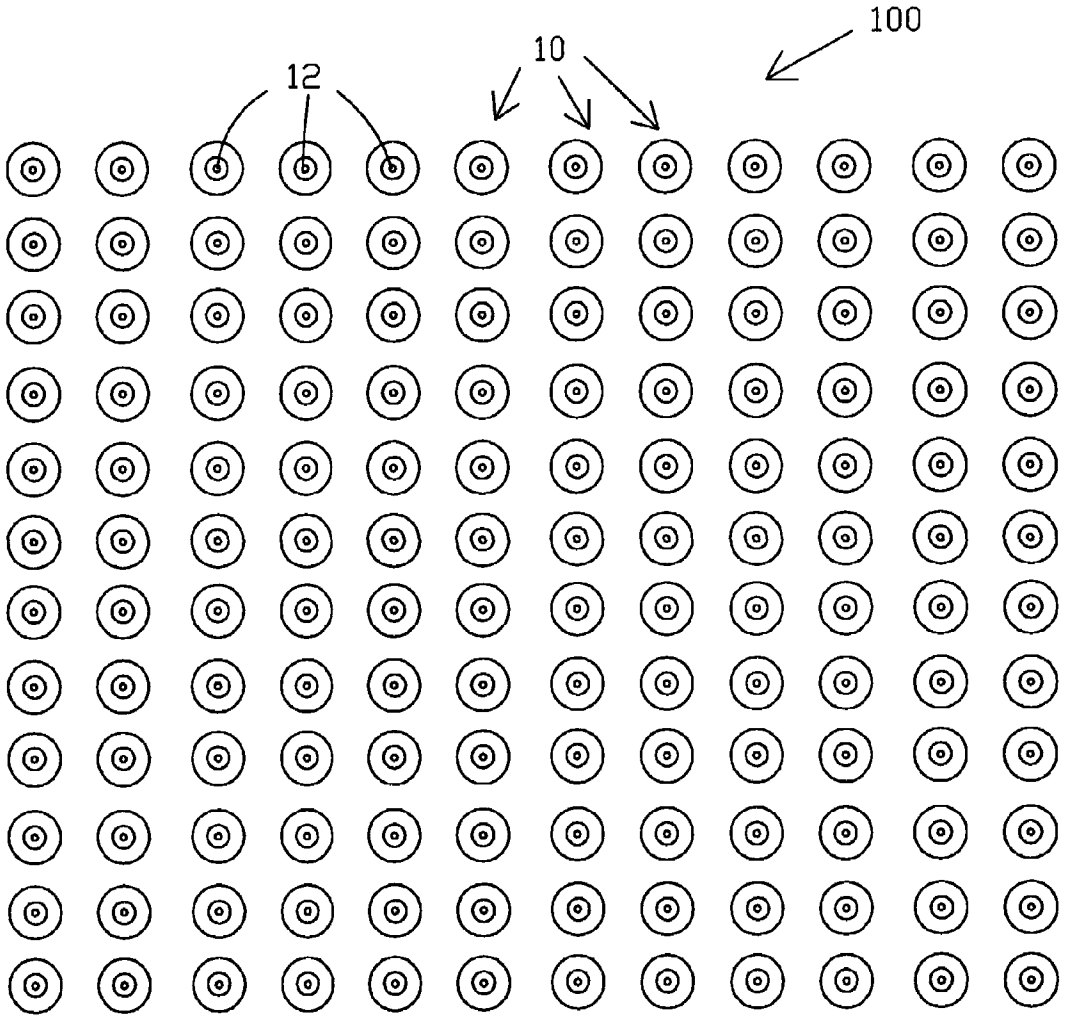
FIG. 3 is a top plan view showing an array of sensors of the type shown in FIG. 1 and FIG. 2.
Figure 4:
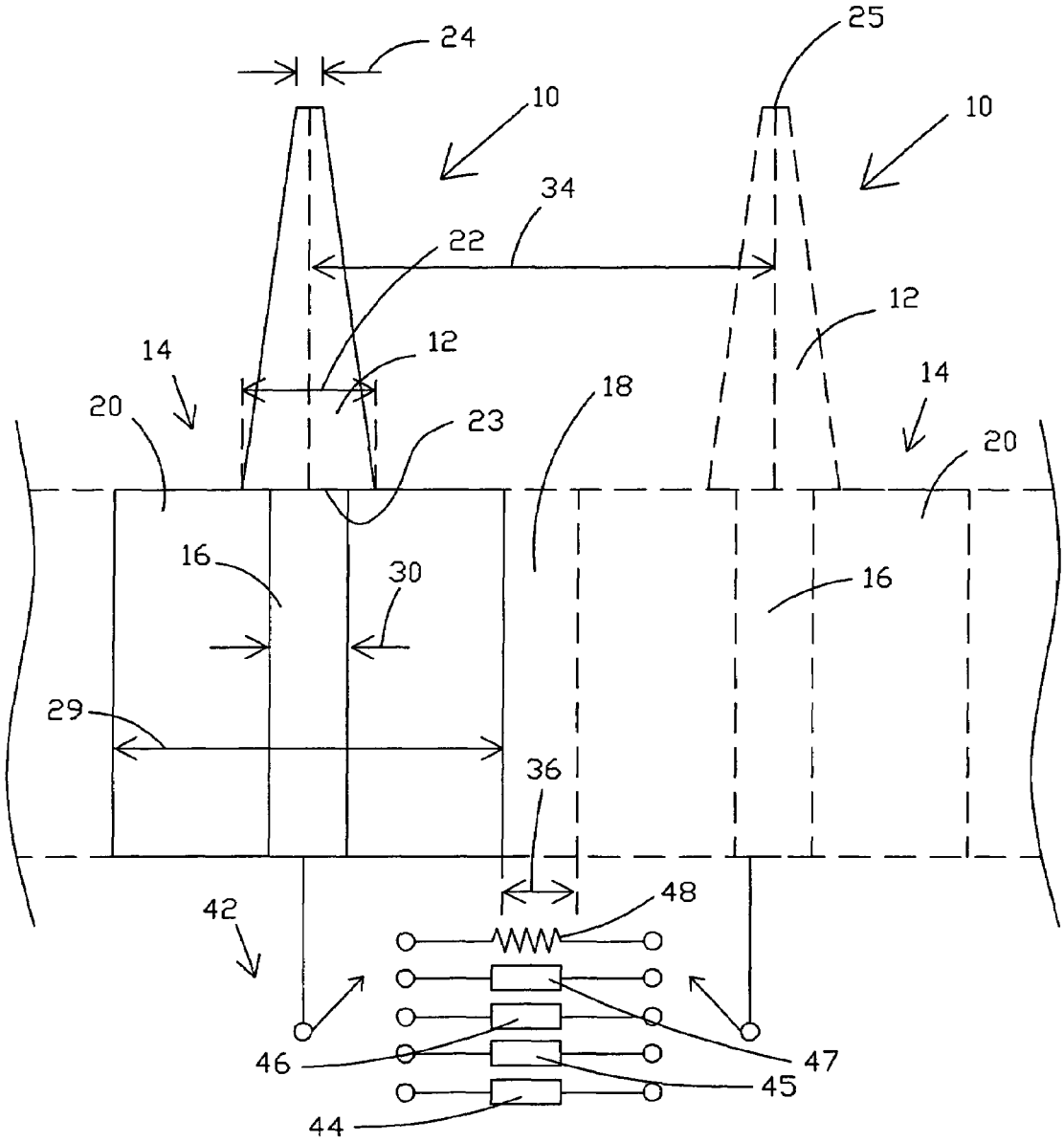
FIG. 4 is a side elevational view, partially in phantom line, showing an array with sensors similar to the sensor of FIG. 1 with normalized relative dimensions of one embodiment of the sensor(s) wherein coaxial transmission lines formed in the ground plate may further selectively connect to switching elements for multifunctional operation of the array in accord with one possible embodiment of the invention.
Figure 4A:
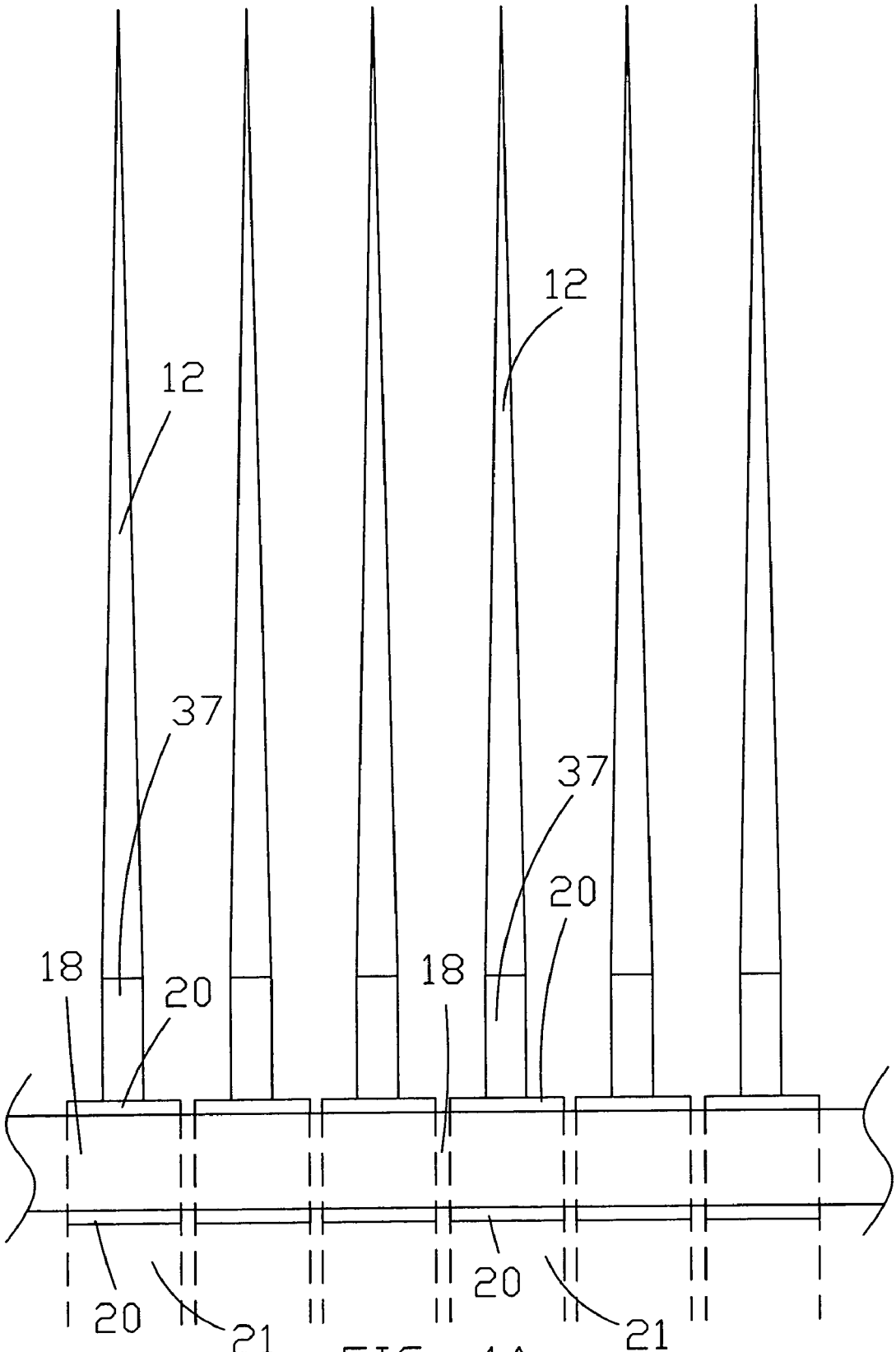
FIG. 4A is a side elevation of a pair of adjacent sensors like the one in FIG. 4, which insofar as the invention is presently understood, is illustrative of relative proportions of a sensor configuration for operational use.

Referring now to FIG. 1, there is shown one possible embodiment of a single sensor element 10, shown in a side elevational view that may be utilized in interface surfaces or interface systems. Array 100 shown in FIG. 3, is an array of sensors such as that of FIG. 1, shown looking down from the top of the array. An enlarged portion of array 100 is shown in FIG. 2. Array 100 may sometimes in this specification or in the appended claims be referred to as an "electromagnetic radiation interface surface" or an "electromagnetic radiation interface system." Sensor 10 is comprised of bristle 12. In this example, bristle 12 is generally conically shaped to provide an impedance match with the dielectric medium surrounding bristle 12 which, in this case, is air. However the shape of bristle 12 is more generally elongate and may vary as desired. One variation is shown in FIG. 4A. As another example, bristle 12 may be frustoconically shaped generally as shown in FIG. 4 with a base 23 and an apex 25. Apex 25 which may be pointed, rounded, flattened, or otherwise shaped as suitable depending on frequency of operation and the like. Depending on the permittivity of air or other medium, such as space, the shape of bristle 12 may be varied in order to provide an impedance match therewith. In one preferred embodiment, apex 25 comprises a distal end diameter 24 at least five times smaller than said proximal end diameter 22 of base 23 (See FIG. 4).

Bristle 12 is electrically connected to dielectrically loaded coaxial transmission line 14 at inner conductor 16. For practical construction concerns, coaxial transmission line 14 may not be the type of co-axial transmission line which is originally in the form of a cable. Especially when hundreds or thousands of sensors, such as sensor 10, are utilized to form an array, as suggested in FIG. 3, coaxial transmission line 14 may be more conveniently formed as an integral part of the construction of sensor 10. For instance, ground plane or conductive plate or ground plane 18 may, in one embodiment, be comprised of a plate into which holes 28, as indicated in FIG. 1 and FIG. 2, are formed that are utilized to define coaxial transmission line 14 which comprises inner conductor 16, annular dielectric material 20, with an outer conductor which may be comprised of the conductive surface of cylinder or hole 28 in conductive plate 18. Thus, inner conductor 16 and annular dielectric material 20 are disposed in the space formed within cylinders or holes 28 of ground plane or plate 18. Plate 18 then also serves to physically support the structure of interface surface or array 100 as well as serve the function of providing an effective transmission line outer conductor for each sensor 10 having an outer conductor diameter equal to diameter 29 (See FIG. 2 and FIG. 4) of hole 28.

Other embodiments, some of which are discussed hereinafter, may or may not include a ground plane, or may or may not include plate 18, and may or may not include dielectric material 20. However, it is presently anticipated that all embodiments will preferably include an array of bristles 12 mounted by some means and some type of termination thereto.

As indicated in FIG. 1, in conjunction with FIG. 2 and FIG. 4, generally conic shaped bristle 12 is an electrically conductive element which has a base diameter 22 (See FIG. 4) of base 23, an apex diameter 24 of apex 25, and a height 26 (See FIG. 1). Bristle 12 could, for instance, be comprised of metal. The conical shape of bristle 12 is chosen to match the impedance of the bristle 12 to an air medium for broadband frequency use. To the extent that other mediums and other desired frequencies are utilized, then the shape of bristle 12 may vary.

Figure 4B:
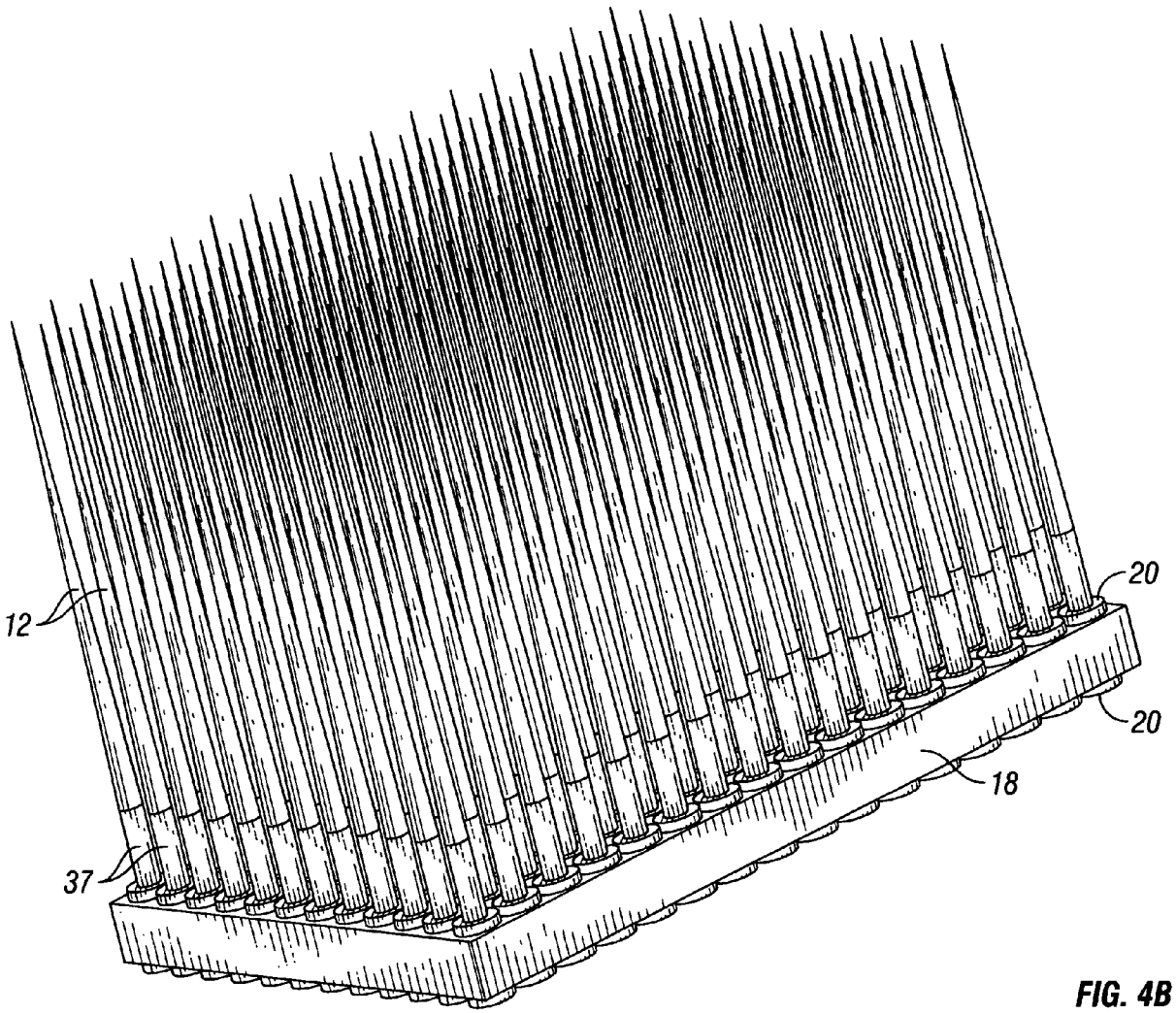
FIG. 4B is a perspective view, which insofar as the invention is presently understood, is illustrative of the hairbrush type construction of a sensor in accord with one possible embodiment of the invention.

The term "bristle" is used because as the number of sensor elements in array 100 increases, and if the overall size of array 100 is small, then array 100 may appear somewhat like a hair brush with "bristles." The term "bristle" herein refers to an individual antenna used to make-up the array 100 of antennas/bristles 12 described herein. As one possible example, see FIG. 4B. In the embodiment of FIGS. 1 and 4, base diameter 22 (See FIG. 4) is chosen so that the impedance of bristle 12 seen by coaxial transmission line 14 matches the characteristic impedance of coaxial transmission line 14. In the example of FIG. 1, each coaxial transmission line 14 comprises inner conductor 16 and annular dielectric material 20 which is disposed in cylinder or hole 28. Thus, each transmission line 14 may be referred to as a "follicle" that extends from and corresponds to a particular bristle 12 in interface surface or array 100.

The characteristic impedance of coaxial transmission line 14 will depend on, among other factors, the diameter 29 (See FIG. 2) of hole 28 for transmission line 14. In this example, diameter 29 of hole 28 is the effective size of an outer conductor of a coaxial cable formed within conductive ground plate 18. The characteristic impedance of coaxial transmission line will also depend on diameter 30 of inner conductor diameter 16 (See FIG. 4), and the selected dielectric material 20 annularly disposed around inner conductor 16 within the conductive wall of cylinder or hole 28.

Referring to FIG. 2, the "signal capture area" of each sensor 10 is referred to as a square formed by preferably equal distances 32 in each of two perpendicular directions around each sensor 10 so as to be uniformly distributed over the area of the array. Thus, the capture area of each individual sensor 10 may in this example be equal to the total array of the array divided by the number of sensors 10 therein.

In this preferred embodiment, sensors 10 are uniformly distributed over the areas of the array as indicated in FIG. 3. Distance 34 is the distance from sensor center to the sensor center of the adjacent sensors 10. Distance 36 is the distance between cylinders or holes 28. As noted above, holes 28 may be formed in conductive plate 18 such that the surface of each cylinder or hole 28 thereby effectively creates the outer conductor of each coaxial transmission line 14. Thus, distance 36 may be restated as the distance from the outer conductor of a coaxial transmission line 14 for a particular sensor 10 to the outer conductor of the coaxial transmission line 14 for the adjacent sensors (See FIG. 2 and FIG. 4).

The normalized dimensions for sensor 10 are discussed hereinafter to provide the relationship between the various dimensions. Normalized dimensions are given because the construction of sensor 10 and/or sensor array 100 may be of different sizes. The different sized dimensions will affect the bandwidth of interface surface or array 100.

However, some dimensions will affect only the upper or lower bandwidth frequency. For instance, selecting an appropriate value for element to element spacing 34 will clearly affect each sensor 10 capture area. Since all other dimensions will scale appropriately, only the upper frequency of operation will be affected by a change in sensor 10 capture area due to the corresponding change in frequency characteristics of coaxial transmission line 14 as the dimensions thereof change.

For convenience, the normalized spacing is given in terms of the element to element spacing 34. Therefore assuming that dimension 34 is 1.0 units, then in one presently preferred embodiment, dimension 24 of apex 25 may be 0.002 units, dimension 22 of base 23 may be 0.43 units, dimension 36 which is the distance between cylinders or holes 28 is 0.10 units, dimension or diameter 30 of inner conductor 16 (see FIG. 4) is 0.28 units, and dimension 29 which is the diameter of cylinder or hole 28 is 0.90 units.

Dimension 36 is the distance between adjacent annular holes or cylinders 28 in ground plane or conductive plate 18 that forms the effective outer conductors of transmission lines 14 as discussed above. Dimension 36 between holes 28 provides the approximate thickness of the effective outer conductor for a coaxial cable formed by making holes in ground plate 18. In one preferred embodiment of the invention, dimension 36 is greater than zero to thereby utilize plate 18 for mechanical stability of array 100 and to provide that the effective outer conductor of the coaxial transmission lines 14 have at least some metallic thickness completely surrounding dielectric material 20.

However, as discussed earlier, ground plane or plate 18 may not be utilized in all embodiments of the invention. Thus, dimension 32 may be made close to or equal to dimension 29 of hole or cylinder 28 in plate 18, or 1.0 units. In another embodiment, the dimension 36 may become very small so that the effective thickness of the outer sheath is small but still may be utilized as an outer conductor for a coaxial cable as discussed above.

It will be understood that the "units" referred to herein are intentionally undefined and may vary depending on the desired construction, bandwidth desired and so forth. The length 26 of bristle 12 is left open and will depend on the particular construction with the best lengths presently left to empirical determination. In one embodiment, a ratio of length 26 to sensor-to-sensor of 12:1 is presently believed to provide an effective embodiment for construction of an array insofar as the invention is presently understood (See FIG. 4A.). The longer the length 26 compared to the wavelength of operations, the better. Actual operational embodiment of sensors 10 may be formed with a uniform diameter pedestal portion 37, as shown in FIG. 4A, extending between ground plane 18 and base 23 of the conical sensor section. In this embodiment, the length of pedestal portion 37 is non-critical. In this example, dielectric material 20, which may or may not include an outer conductive sheath, extends upwardly somewhat from ground plane 18.

In any practical embodiment, interface surface or array 100 of sensor elements 10 will have a finite physical extent and the spacing of each sensor 10 from the neighbors thereof will have some practical minimum value. The lower frequency bound at which the interface surface or array 100 will exhibit good absorption will be determined by the finite physical extent of the array and may, depending on construction, be related to the wavelength or half wavelength of the lowest frequency to be captured. The upper frequency bound will depend on the spacing between individual sensor elements 10 and/or the upper frequency limits of coaxial transmission line 14.

For an example, which may vary considerably depending on construction, a one square meter array may have a bandwidth with a lower frequency of 300 MHz. If the upper frequency cut off is determined by coaxial cable having an upper frequency of 25 GHz, then it will be appreciated that the bandwidth is very wide. Moreover, a much smaller array with 0.1 square meter dimensions might then have a bandwidth with a lower frequency of very roughly 3 GHz with the upper frequency still at 25 GHz assuming the coaxial cable dimensions are not made smaller. Based on these very rough approximations, this would also result in a very wide bandwidth antenna having a relatively small capture area. It will be understood that the upper frequency cut off of coaxial transmission line 14 can be much higher and may be quite high depending on the dimensions thereof. If the coaxial transmission line 14 is operated as a TEM transmission line, e.g., a commonly used mode of operation wherein the electric and magnetic field vectors are both normal to the direction of propagation, then there is no lower cutoff frequency produced as a result of coaxial transmission line 14.

The characteristic impedance of the TEM mode of propagation in coaxial transmission line 14 is a real resistance, e.g., 50 Ohms. When a coaxial transmission line with characteristic impedance $Z_0$ is terminated by a resistive element such as element 38 with an impedance of $Z_0$, then transmission line 14 is said to be matched. No electromagnetic energy is reflected from the matching termination. In other words, all electromagnetic energy propagating in transmission line 14 is absorbed by element 38. Thus, if each TEM transmission line 14 (follicle) in array 100 supporting a bristle 12 on interface surface or array 100 is terminated in a resistive element that matches the TEM transmission line 14 characteristic impedance, then all electromagnetic energy incident on interface surface or array 100 will be absorbed by the corresponding resistive element, e.g., element 38. In this case, interface surface or array 100 will appear electrically "black" to an observer who has transmitted an electromagnetic wave or pulse and is looking for a return signal.

As noted above, prior art broadband receiving systems are performance limited by the inability to realize sufficient spurious-free dynamic range in the analog portions of the receiving system. Digital signal processing (DSP) radio systems, on the other hand, have much greater spurious free dynamic range (SFDR) because the SFDR increases about 5 dB for each mantissa bit. For instance, software defined radio may utilize a radio receiver and/or a transmitter, where the received signal is digitized and then processed using software-programmable digital signal processing techniques. Digitization may occur at the RF, IF, or base band. Thus, a typical DSP system using 24 bit arithmetic could exhibit 120 dB SFDR, which is much higher than prior art broadband systems.

In the disclosed system, each bristle 12 collects electromagnetic energy from a small, scaleable, capture area. The total capture area of interface or array 100 is the sum over all bristles 12. If the signal from each bristle 12 is first converted to a digital form by a plurality of A/D converters, and all signals are combined in the digital domain, then there will be an improvement in SFDR for the combined receiver system. Thus, an A/D converter 40 (FIG. 1) may be utilized with each bristle 12 and transmission line 14 to sample the electromagnetic potential relative to a common plane such as ground plane 18 and periodically convert the magnitude of the electromagnetic potential to a digital word. To a first approximation, the improvement is proportional to the ratio of the capture area of a single bristle 12 to the capture area of all bristles combined in interface surface or array 100. Thus, if interface surface or array 100 has 1000 bristles, then interface surface or array 100 would have 30 dB more SFDR than an antenna with the same capture area, other technologies being equal.

Commonly assigned U.S. Pat. No. 6,466,167 entitled "Antenna Systems and Method for Operating Same" is illustrative of a system which first converts the signal from each bristle to a digital form and then performs processing, including sampling thereon. It is of particular utility with electromagnetic radial air-interface systems in accordance with the present invention, and is hereby incorporated herein by reference in its entirety.

Further, using monolithic technologies, as discussed subsequently in connection with FIG. 5 and FIG. 6, an interface system with 1000 bristles may be easier and cheaper to fabricate and deploy. The digital words describing the electromagnetic potentials of large numbers of sensors 10 may be combined to produce a digital replica of the incident electromagnetic energy arriving at interface surface or array 100. This digital replica of the incident electromagnetic energy field may be further processed to simultaneously recover a plurality of signals arriving at interface surface or array 100. One or more frequencies from one or more directions of arrival may characterize each signal.

A dual system may be used to independently excite each sensor 10 in one or more interface surfaces or arrays 100 such that the coordinated excitation potentials launch an electromagnetic energy field carrying a plurality of signals wherein each signal may be characterized by one or more frequencies and one or more directions of propagation.

In another embodiment of the invention, a means is provided for creating an active surface capable of creating a deceptive electrical appearance by means of programmable electronic modules. Referring to FIG. 4, switching means 42 may or may not be utilized, as desired, to switch between electronic modules 44, 45, 46, 47, and 48, for each bristle 12. In another embodiment, a single type of electronic module may be utilized for terminating transmission line 14 to provide a dedicated function interface surface or array 100. While a mechanical type switch is shown in FIG. 4, a more practical embodiment may utilize electronic switches, such as FET switches, which may be easily implemented in monolithic integrated circuit construction. Alternately the modules may comprise means for varying impedances including variable reactances or variable resistances. Note that resistance module 48 may be connected across center conductors 16 of each adjacent transmission line 14 rather than between center conductor 16 and ground plane 18 as discussed earlier. In this case, $2Z_0$ rather than $Z_0$ results in impedance matching for each transmission line 14. However, the impedance as seen by the transmission line is still $Z_0$ and therefore the connection across two transmission lines 14 is equivalent to connecting each impedance between transmission line center conductor 16 and ground plane 18 as shown in FIG. 1. Thus, with switch 42 connected to module 48, all incident electromagnetic energy will be absorbed by resistive elements of module 48 and interface surface or array 100 will appear electrically "black" as discussed hereinbefore. Note that another module, such as module 47, could comprise a resistance with a negative magnitude whereby the reflected signal will be amplified by a factor relating to the real magnitude. In other words a reflection coefficient has both a real and an imaginary part. The real part may be used to control the amplitude of the reflected wave. If the real part is positive, then a reflected signal will be attenuated by a factor related to the real magnitude. If the real part is negative, as discussed above, then the reflected signal will be amplified by a factor related to the real magnitude.

If the energy ports at the end of each transmission line 14 are terminated by a means that reflects energy, e.g., a reactive termination which might comprise termination module 46, then the surface will appear as a reflecting surface to incident electromagnetic radiation. Variations in the reactance magnitude and sign will determine the phase of the reflected signal. If switch 42 switches between characteristic impedance of 48 and reflective termination module 46, then interface surface or array 100 can appear to change electrical characteristics completely with respect to an observer who has launched an electromagnetic wave. Thus, if variable controls such as switch 42 or if, for instance, module 45 comprises other variable means for the real and imaginary aspects of the reactance, then the reflected signal will also be correspondingly varied. If the end of each transmission line 14 is terminated by means that is altered in phase and/or amplitude, then the reflected wave could appear to an observer to be caused by a different object. If the energy is modulated, such as by a biphase modulator, or any other suitable time-varying phase modulator in module 44, then the modulation can be made to appear on the reflected wave. If the observer is measuring Doppler effects (the difference in frequency between incident and reflected signals) to thereby determine the speed of interface surface or array 100, then the so modulated wave could cause a fixed-location surface to appear to be moving at a rate of speed determined by the modulation frequency and/or a moving surface to appear to be moving at a faster or slower speed. If frequency selective filters are added to the ends of transmission lines 14, then the reflected energy would have a tailored frequency dependent appearance. In another embodiment, some transmission lines 14 could be terminated in one way, and others terminated in another way to produce a return signature that deceives the observer. In another embodiment, each termination module may comprise a transmitter such that an electromagnetic wave is produced by a combination of the transmitters transmitting through the array of bristles 12. The transmitters may be either analog or digital transmitters. Thus, the disclosed novel interface surface or array 100 may offer a wide variety of functions acting on electromagnetic waves that may be deployed dynamically by means of programmable and/or switchable electronic circuits, such as circuits 44, 45, 46, 47, 48, and/or other circuits, that terminate transmission lines 14.

Figure 5:
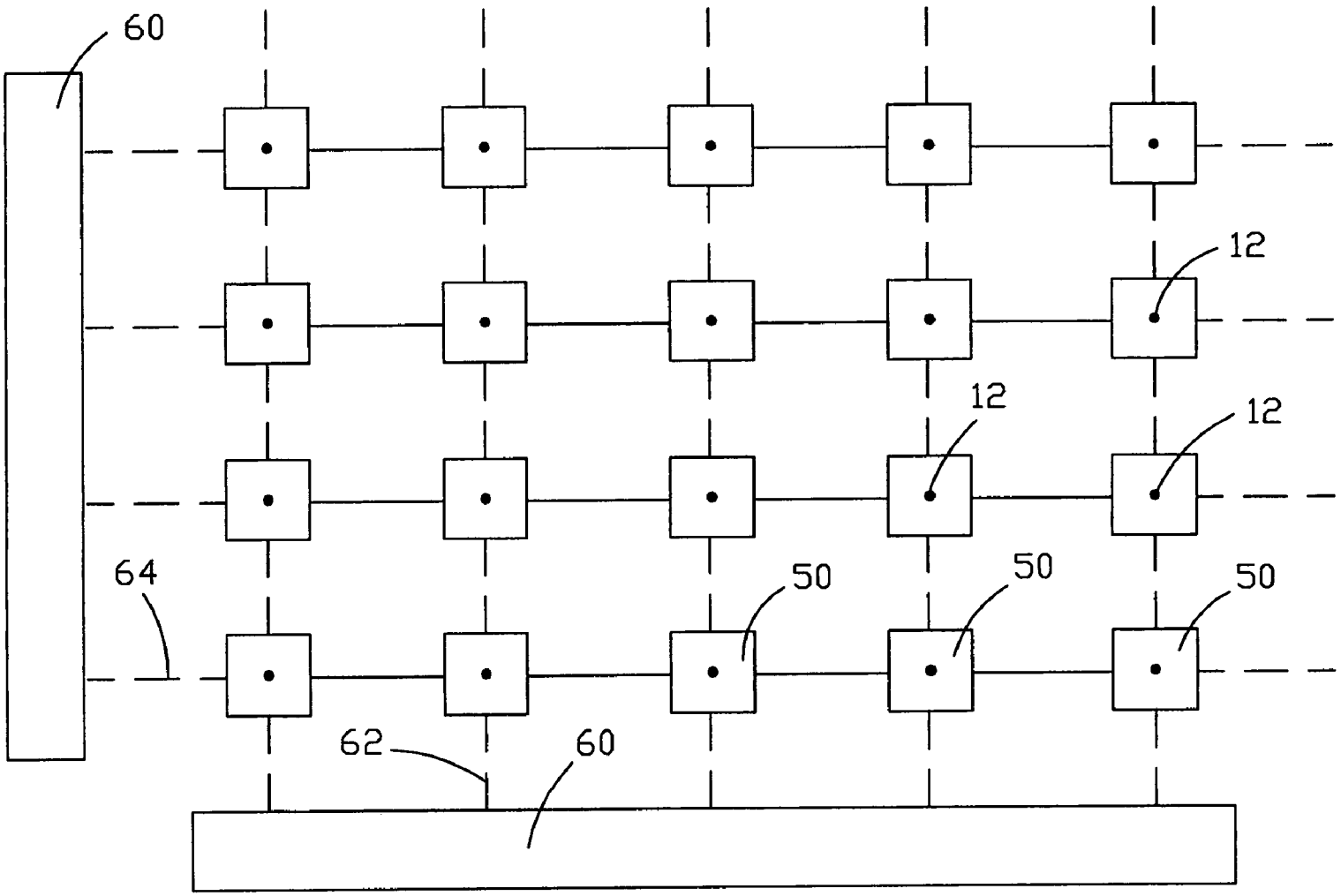
FIG. 5 is a top plan view schematically showing an array of interface sensors and terminations which may be monolithically implemented in accord with another embodiment of the invention.
Figure 6:
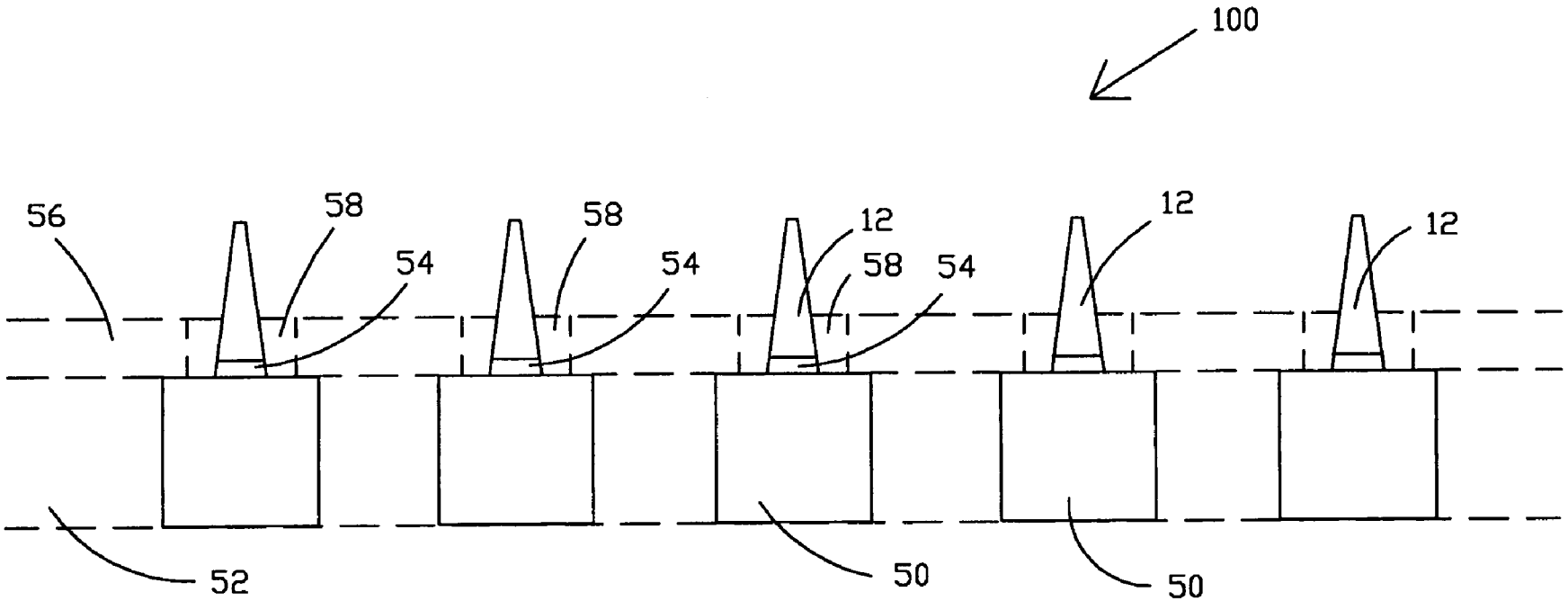
FIG. 6 is a side elevational view of the array shown in FIG. 5 in accord with the present invention.

FIG. 5 and FIG. 6 show interface surface or array 100 which may be implemented monolithically. Each bristle 12 is terminated in a module 50. Module 50 is an integrated circuit that may or may not include FET switches to switch between various termination packages, such as any of the termination packages described above. For instance as discussed above, termination packages may be designed for absorbing electromagnetic energy completely for stealth (termination of transmission lines at their characteristic impedance, recovering all energy as a perfect antenna (digital receivers connected to all transmission lines), reflecting energy with tailored frequency dependent appearance (frequency selective filters connected to all or selected transmission lines), reflecting modulated energy (biphase modulators connected to all transmission lines), and/or sending signals (transmitters connected to each transmission line). Various other means may be provided for interconnecting the modules, e.g., resistance modules are connected across and between sensors of each adjacent set of sensors and/or between each sensor and the surrounding conductor.

FIG. 6 shows a side view. Each package 50 may be implemented within a larger integrated circuit substrate or layer 52. Different means for connecting bristles 12 to packages 50 may be utilized. For instance, each bristle 12 may plug into a metallic socket 54 that is etched from an upper metallic layer as part of the integrated circuit package. Depending on the frequencies involved, layer 56 may or may not be a ground plane with cylinders 58 filled with dielectric material. For instance, layer 56 may simply be a layer of dielectric material with bristles 12 also comprising the inner conductor of the transmission line. As another alternative, depending on the frequencies, wherein the diameter of the transmission line will decrease in order to accommodate higher frequencies, array 100 may not include either the ground plane or dielectric material but instead rely on the shape and size of bristle 12 to provide all impedance matching with respect to the medium and packages 50. Moreover, the impedances produced in packages 50 may be varied and/or variable to provide impedance matching with respect to bristle 12.

Interface means or processors 60 may be utilized to communicate with packages 50 to coordinate data flow and control the activities thereof through control/data lines 62 and 64. Thus, it will be appreciated that the concepts discussed in connection with interface surface or array 100, whereby the surface can act in many different modes depending on the termination packages, can be implemented in different ways with some presently preferred embodiments being disclosed herein.

While the invention has been described in relation to employing the hereinabove disclosed principles of operation to a square polygon form of tesselation of an array, it is to be understood that they may be applied to other forms of tesselation as well. Further, while described relative to sensor 10 projecting normal to a flat supporting surface, the principles may be also applied to sensor projecting from other shaped surfaces such as a cylindrical, spherical, conical, elliptical, hemispherical, or any other desired shape. While one preferred embodiment utilizes coaxial transmission line 14 for connecting each bristle 12 to a desired termination, other types of transmission lines including strip lines, micro strips, or other suitable means for transmitting energy at radio wave frequencies may be utilized.

Many additional changes in the details, materials, steps and arrangement of parts, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. An electromagnetic wave interface system, comprising:

a partitioned array of sensor elements forming a surface of said electromagnetic wave interface system, each sensor element having conductive material, at least a portion of each sensor element being conical, to match an impedance of said sensor element to an air medium for broadband frequency use with each sensor element having a distal end and a proximal end with said distal end having a distal end diameter smaller than a proximal end diameter and with each of said sensing elements capable of collecting electromagnetic energy for a scaleable capture area;

a plurality of termination sections, a respective one of said termination sections being electrically connected to said proximal ends of a pair of said sensor elements; and a dielectric support structure with said termination sections electrically connected to adjacent sensor elements such that the differential energy between adjacent sensor elements is capable of being captured.

2. The system of claim 1 wherein separate termination sections are provided for at least one polarization.

3. The system of claim 2 wherein said sensor elements are located at intersections of a uniform rectangular grid such that rows and columns of said sensor elements align with orthogonal linear polarizations of an incident electromagnetic wave.

4. The system of claim 3 wherein one termination section of said termination sections is electrically connected between each adjacent pair of vertically aligned sensor elements and said one termination section is electrically connected between each pair of horizontally aligned sensor sections such that there are approximately two termination sections for each of said sensor elements and such that one termination section terminates the horizontally polarized differential energy between a first pair of adjacent sensor elements and a second termination terminates the vertically polarized differential energy between a second pair of adjacent sensor elements wherein for a given large rectangular array of N sensor elements with approximately 2N termination sections, approximately N termination sections will be aligned with the horizontal polarization component of incident electromagnetic energy and approximately N termination sections will be aligned with the vertical polarization component of incident electromagnetic energy.

5. The system of claim 4 wherein a maximum absorption of incident radiation occurs in said termination sections when the Poynting vector of the incident radiation is aligned with axes of said sensor elements and the direction of propagation is from the distal end of a sensor element to the proximal end of the same sensor element where said termination section is located.

* * * * *